US010682648B2

(12) United States Patent
Imai et al.

(10) Patent No.: US 10,682,648 B2
(45) Date of Patent: Jun. 16, 2020

(54) PLUG-INTEGRATING CONTAINER

(71) Applicant: SURPASS INDUSTRY CO., LTD., Saitama (JP)

(72) Inventors: Takashi Imai, Saitama (JP); Masahiro Hasunuma, Saitama (JP); Masamichi Kobayashi, Saitama (JP)

(73) Assignee: SURPASS INDUSTRY CO., LTD., Saitama (JP)

( * ) Notice: Subject to any disclaimer, the term of this patent is extended or adjusted under 35 U.S.C. 154(b) by 687 days.

(21) Appl. No.: 14/920,829

(22) Filed: Oct. 22, 2015

(65) Prior Publication Data

US 2016/0122091 A1 May 5, 2016

(30) Foreign Application Priority Data

Oct. 31, 2014 (JP) ..... 2014-222796

(51) Int. Cl.
*B65D 51/16* (2006.01)
*B01L 3/00* (2006.01)
(Continued)

(52) U.S. Cl.
CPC ..... *B01L 3/523* (2013.01); *B01L 3/561* (2013.01); *B01L 2200/026* (2013.01);
(Continued)

(58) Field of Classification Search
CPC .... B07L 3/253; B07L 3/561; B07L 2200/026; B07L 2200/0684; B07L 2300/042;
(Continued)

(56) References Cited

U.S. PATENT DOCUMENTS 4,392,579 A 7/1983 Uhlig et al.
4,736,926 A * 4/1988 Fallon ..... B67D 1/0832 137/212
(Continued)

FOREIGN PATENT DOCUMENTS

DE 975391 C 11/1962
DE 2530755 A1 1/1977
(Continued)

OTHER PUBLICATIONS

Extended European Search Report (EESR) from corresponding European Application No. 15191777.0 dated Mar. 1, 2016; 9 pgs.
(Continued)

*Primary Examiner* — J. Gregory Pickett
*Assistant Examiner* — Niki M Eloshway
(74) *Attorney, Agent, or Firm* — MH2 Technology Law Group LLP

(57) ABSTRACT

The plug-integrating container includes a container body having an opening part having external threads formed on its outer circumferential surface, a plug having a locking groove for connection to a socket, and a cap having formed on its inner circumferential surface internal threads fastened to the external threads. In the plug-integrating container, the container body has an open end formed at an axis directional end of the opening part, the plug has an annular part formed at an axis directional end and having the same diameter as that of the open end, the open end and the annular part are joined together by welding as they are butted against each other, and the opening part and the plug are accommodated inside the cap when the external threads and the internal threads are fastened together.

2 Claims, 7 Drawing Sheets

(51) Int. Cl.
*B65D 51/18* (2006.01)
*B65D 41/04* (2006.01)

(52) U.S. Cl.
CPC . *B01L 2200/0684* (2013.01); *B01L 2300/042* (2013.01); *B65D 41/0442* (2013.01); *B65D 51/1688* (2013.01)

(58) Field of Classification Search
CPC ... B07L 41/0442; B67D 7/007; B67D 7/0261; B67D 7/0266; B67D 7/0288; B67D 7/0277; B65D 41/0442; B65D 51/1688
USPC ..... 220/254.8
See application file for complete search history.

(56) References Cited

U.S. PATENT DOCUMENTS 4,785,973 A * 11/1988 Kobe ..... B67D 1/04 137/322
4,832,237 A 5/1989 Hurford, Jr.
5,335,821 A * 8/1994 Osgar ..... B65D 85/84 222/105
5,526,956 A * 6/1996 Osgar ..... B65D 85/84 222/105
6,015,068 A * 1/2000 Osgar ..... B01J 4/00 222/105
6,079,597 A * 6/2000 Rauworth ..... B65D 1/20 137/212
8,371,469 B2 * 2/2013 Takedutsumi ..... B65D 77/06 220/495.03
8,590,566 B2 * 11/2013 Hasunuma ..... B67D 7/0294 137/588
8,733,598 B2 * 5/2014 Nelson ..... B67D 7/72 222/1
9,802,807 B2 * 10/2017 Ware ..... B67D 7/0261
2006/0071007 A1 4/2006 Tsutsumi et al.
2009/0020176 A1 1/2009 Hasegawa et al.
2010/0102094 A1 4/2010 Rice et al.
2012/0037625 A1 2/2012 Hasunuma et al.
2012/0111871 A1 * 5/2012 Sitabkhan ..... A62B 7/14 220/562
2014/0117589 A1 * 5/2014 Vanswijgenhoven ..... F17C 1/06 264/503
2014/0345368 A1 * 11/2014 Dervaes ..... B65B 3/00 73/53.01
2016/0280531 A1 9/2016 Dormeval et al.

FOREIGN PATENT DOCUMENTS

DE 9212525 U1 1/1993
JP S63-232127 A 9/1988
JP H06-051200 U 7/1994
JP 2002-502778 A 1/2002
JP 2007-204102 A 8/2007
JP 2008-087769 A 4/2008
JP 2012-035900 A 2/2012
WO 2014/147034 A1 9/2014

OTHER PUBLICATIONS

Japanese Office Action dated Feb. 6, 2018 in JP Patent Application No. 2014-222796, 6 pages.

* cited by examiner

PLUG-INTEGRATING CONTAINER

CROSS-REFERENCE TO RELATED APPLICATIONS

This application is based on Japanese Patent Application No. 2014-222796, the contents of which are incorporated herein by reference in its entirety.

TECHNICAL FIELD

The present disclosure relates to a plug-integrating container.

BACKGROUND ART

In general, a liquid such as chemicals used for semiconductor manufacturing apparatuses and general chemicals is charged at a production plant into a storage container, which is then shipped with a cap attached to an opening part formed on the storage container. It is known that a special cap with piping fixed thereto is attached to the opening part for removing the liquid stored in such a storage container (e.g., see Japanese Unexamined Patent Application, Publication No. S63-232127).

According to Japanese Unexamined Patent Application, Publication No. S63-232127, the liquid stored in the storage container can be drawn up through the piping or extracted by supplying a gas for pumping out the liquid into the storage container.

SUMMARY

Technical Problem

When using the storage container disclosed in Japanese Unexamined Patent Application, Publication No. S63-232127, the storage container filled with a liquid at a production plant is transported with a cap attached thereto and the cap is removed to be replaced with the special cap at a site of use of the liquid. Because the piping is installed to the special cap as it is, it requires a process of coupling itself to piping toward which the liquid is supplied at the site of use of the liquid. For example, the process may involve attaching a plug to the piping installed to the special cap and coupling the plug to a socket attached to the piping toward which the liquid is supplied.

Thus, the technique disclosed in Japanese Unexamined Patent Application, Publication No. S63-232127 requires a process of removing the cap of the storage container to replace the cap with the special cap and a process of attaching the plug to the piping installed to the special cap before the liquid can be extracted.

The present disclosure has been made under such a circumference and an object of the present disclosure is to provide a plug-integrating container which enables easy connection to a socket for filling in or extracting a liquid while protecting a plug joined to a container body from an external impact.

Solution to Problem

In order to solve the foregoing problem, the following solutions have been adopted in the present disclosure.

A plug-integrating container according to an aspect of the present disclosure includes a container body including a cylindrically formed opening part extending in an axial direction, the opening part having external threads formed on an outer circumferential surface thereof, a cylindrically formed plug extending in the axial direction and having around the axis a groove part for connection to a socket, and a cap having formed on an inner circumferential surface thereof internal threads fastened to the external threads formed on the opening part, in the plug-integrating container, the container body includes a first annular part formed at an end of the opening part in the axial direction, the plug includes a second annular part formed at an end in the axial direction and having the same diameter as that of the first annular part, the first annular part and the second annular part are joined together by heat bonding or welding as the first annular part and the second annular part are butted against each other, and the opening part and the plug joined to the opening part are accommodated inside the cap when the external threads and the internal threads are fastened together.

According to a plug-integrating container in accordance with an aspect of the present disclosure, the first annular part formed on the axial directional end of the opening part of the container body extending in the axial direction and the second annular part formed on the axial directional end of the cylindrically formed plug extending in the axial direction are joined together by heat bonding or welding as they are butted against each other. Because the plug has the groove part for connection to the socket, the socket for filling in or extracting a liquid can be easily connected to the plug joined to the container body containing the liquid.

The joint obtained by heat bonding or welding might be damaged by an external impact exerting a force acting on the plug in a direction orthogonal to the axial direction. According to a plug-integrating container in accordance with an aspect of the present disclosure, the opening part of the container body and the plug joined to the opening part are accommodated inside the cap when the external threads formed on the outer circumferential surface of the opening part of the container body and the internal threads formed on the inner circumferential surface of the cap are fastened together. This prevents damage of the joint between the container body and the plug due to an external impact exerting a force acting on the plug in a direction orthogonal to the axial direction.

In a plug-integrating container in accordance with an aspect of the present disclosure, it may be configured such that a seal member is attached to an inner circumferential surface of the cap, the seal member contacting an outer circumferential surface of the plug to form a seal area along the entire circumference of the axis, that the cap includes a through hole disposed at a position such that the through hole does not communicate with the inside of the container body when the seal area is in a formed state, and that the seal area switches from the formed state to an unformed state to communicate the inside of the container body with the position where the through hole is disposed before the external threads and the internal threads become unfastened from each other.

According to the configuration, the seal member forms the seal area between the inner circumferential surface of the cap and the outer circumferential surface of the plug when the external threads formed on the outer circumferential surface of the opening part of the container body and the internal threads formed on the inner circumferential surface of the cap are completely fastened together. This prevents in the completely fastened state the gas generated from the liquid such as a chemical contained inside the container body from leaking out of the container body.

In addition, according to the configuration, the seal area switches from the formed state to the unformed state before the external threads and the internal threads become unfastened from each other. Accordingly, the seal area switches into the unformed state to allow the gas generated inside the container body to flow out through the through holes before the external threads and the internal threads become unfastened from each other. As a result, the pressure inside the container body generally corresponds to the outside pressure at the time the external threads and the internal threads become unfastened from each other. The gas flows out through the through holes before the external threads and the internal threads become unfastened from each other, and thus this prevents the gas generated inside the container body from suddenly flowing out to fly the cap or prevents the liquid contained in the container body from leaking out.

In a plug-integrating container according to an aspect of the present disclosure, a space may be formed, when the external threads and the internal threads are completely fastened together, between a top surface of the plug and a bottom surface of the cap facing the top surface, the top surface and the bottom surface being spaced by a predetermined distance.

In this way, a space can be secured for accommodating a tube to be inserted into the container body inside the cap. Accordingly, the plug-integrating container can be transported or stored with or without the tube accommodated in the container body.

The plug-integrating container with the configuration may include a cylindrically formed tube which extends in the axial direction and is inserted through the plug into the container body, the tube may include a flange part having a diameter longer than an inner diameter of the plug and a tube body having a diameter shorter than the inner diameter of the plug, and the flange part may be disposed such that when the external threads and the internal threads are completely fastened together, the flange part is sandwiched between the top surface of the plug and the bottom surface of the cap facing the top surface.

In this way, the container can be transported or stored with the flange part of the tube which is inserted into the container body fixed as it is sandwiched between the top surface of the plug and the bottom surface of the cap facing the top surface.

According to the present disclosure, a plug-integrating container can be provided which enables easy connection to a socket for filling in or extracting a liquid while protecting a plug joined to a container body from an external impact.

DESCRIPTION OF EMBODIMENTS

Hereinafter, a plug-integrating container 100 according to an embodiment of the present disclosure will be described with reference to the drawings.

Figure 1:
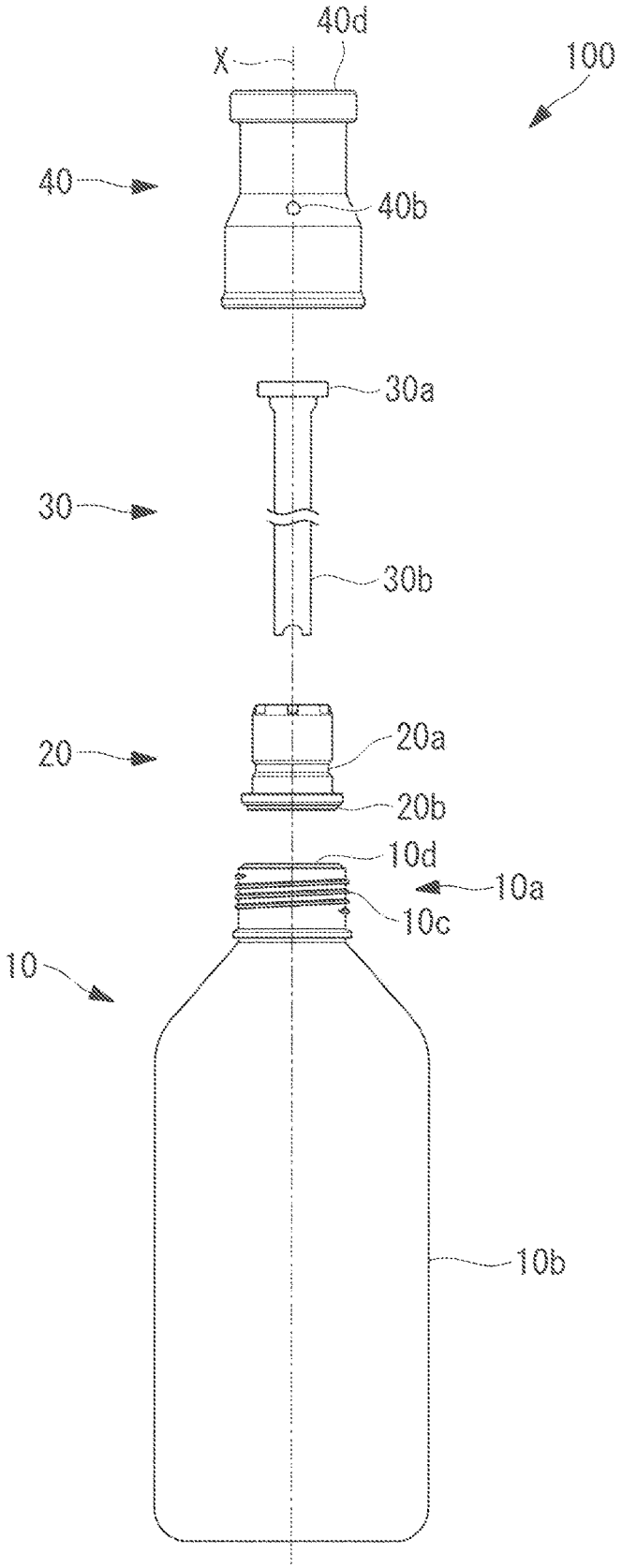
FIG. 1 is an exploded assembly view of a plug-integrating container according to an embodiment.

The plug-integrating container 100 according to the present embodiment is a container for storing a liquid such as a chemical filled at a production plant. As illustrated in FIG. 1, the plug-integrating container 100 according to the present embodiment includes a container body 10, a plug 20, a dip tube 30, and a cap 40.

The container body 10 includes a cylindrical opening part 10*a* extending along an axis X and a container part 10*b*. The opening part 10*a* and container part 10*b* are integrally molded into a single member. The container body 10 is formed of a high density polyethylene (HDPE) or a fluorocarbon resin (e.g., PFA or PTFE), for example. The opening part 10*a* of the container body 10 has external threads 10*c* formed on its outer circumferential surface around the axis X. The external threads 10*c* are fastened to internal threads 40*a* of the cap 40 that will be discussed later.

The opening part 10*a* has at an upper end thereof along the axis X an annular open end 10*d* (first annular part) extending around the axis X.

The plug 20 is a cylindrical member extending along the axis X. The plug 20 has on its outer circumferential surface an endless locking groove 20*a* extending around the axis X. The locking groove 20*a* is a member for attaching a socket 200 that will be discussed later to the plug 20 while locking a plurality of balls 66*a* of the socket 200. The plug 20 is formed of a high density polyethylene (HDPE) or a fluorocarbon resin (e.g., PFA or PTFE), for example.

An annular part 20*b* (second annular part) having the same diameter as that of the open end 10*d* of the container body 10 is formed at an outer circumferential part of an axis X directional lower end of the plug 20.

Figure 2:
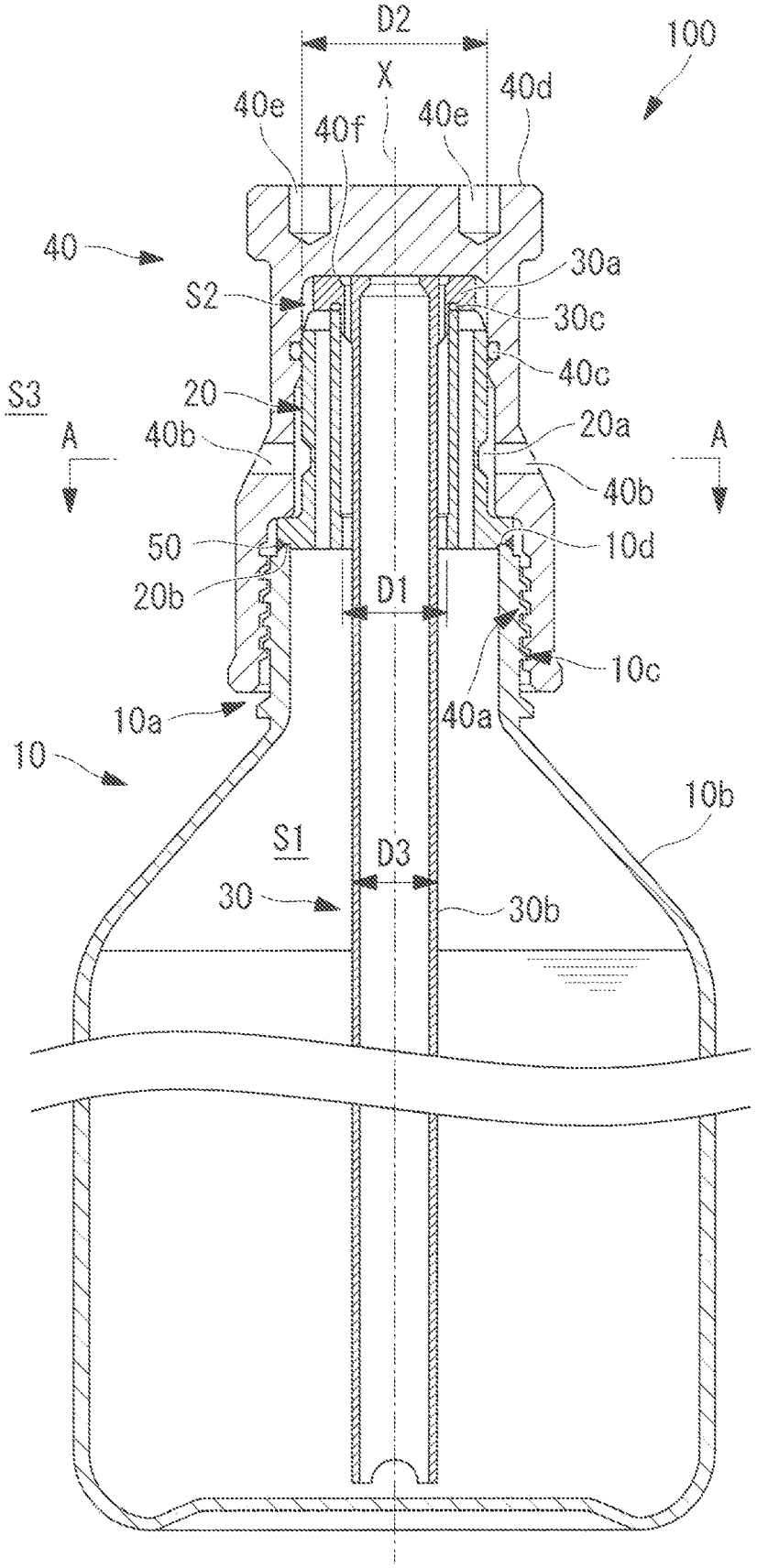
FIG. 2 is a vertical cross-sectional view of a plug-integrating container according to an embodiment illustrating a cap and a container body completely fastened together.

As illustrated in FIG. 2, the open end 10*d* of the container body 10 and the annular part 20*b* of the plug 20 are joined together by welding using a welding material 50 as they are butted against each other. The welding material 50 is formed of a high density polyethylene (HDPE) or a fluorocarbon resin (e.g., PFA), for example. The plug 20 is joined to the container body 10 by joining the open end 10*d* of the container body 10 and the annular part 20*b* of the plug 20 with the welding material 50.

The open end 10*d* of the container body 10 and the annular part 20*b* of the plug 20 are joined together by welding using the welding material 50 as in the specification, however, they may be otherwise joined. For example, the open end 10*d* of the container body 10 and the annular part 20*b* of the plug 20 may be joined together by heat bonding.

As described above, the plug-integrating container 100 of the present embodiment is an integral container in which the container body 10 and the plug 20 are joined together. This makes it easier to manufacture each part and can reduce the manufacturing cost of the mold as compared with integrally molding the container body 10 and the plug 20 as a single member.

Figure 6:
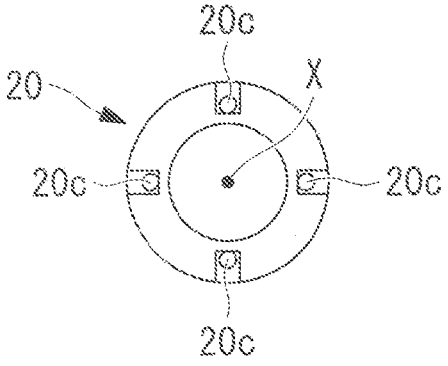
FIG. 6 is a plan view of a plug in FIG. 2 as seen in the axial direction.

As illustrated in FIGS. 2 and 6, the plug 20 has four gas flow channels 20*c* each at the same distance from the axis X and spaced uniformly from each other around the axis X. The gas flow channels 20*c* each communicate an inner space S1 of the container body 10 with an outer space S2 of the plug 20. As illustrated in FIGS. 2 and 6, the gas flow channels 20*c* are open in a radial direction orthogonal to the axis X so as not to be closed by a flange part 30*a* of the dip tube 30 even when the flange part 30*a* is placed on a top surface of the plug 20.

The dip tube 30 is cylindrically formed, extends along the axis X and is inserted through the plug 20 into the container body 10. The dip tube 30 is formed of a high density polyethylene (HDPE) or a fluorocarbon resin (e.g., PFA), for example.

As illustrated in FIG. 2, the dip tube 30 includes the flange part 30*a* having an outer diameter D2 longer than an inner diameter D1 of the plug 20, a tube body 30*b* having an outer diameter D3 shorter than the inner diameter D1 of the plug 20, and an O ring 30*c*. The dip tube 30 is held by the plug 20 with the tube body 30*b* inserted in the plug 20 and a lower surface of the flange part 30*a* in contact with the top surface of the plug 20. The O ring 30*c* is an endless elastic member provided at the lower surface of the flange part 30*a*, and forms an annular seal area extending around the axis X between the lower surface of the flange part 30*a* and the top surface of the plug 20.

As illustrated in FIG. 2, the flange part 30*a* is placed such that when the external threads 10*c* of the container body 10 and the internal threads 40*a* of the cap 40 are completely fastened together, the flange part 30*a* is sandwiched between the top surface of the plug 20 and a bottom surface 40*f* of the cap 40 facing the top surface. The cap 40 is prevented from moving downwardly along the axis X as the flange part 30*a* is brought into contact with the bottom surface 40*f* of the cap 40 at its top surface and with the top surface of the plug 20 at its lower end surface. At this state, the external threads 10*c* of the container body 10 and the internal threads 40*a* of the cap 40 are completely fastened together.

Figure 3:
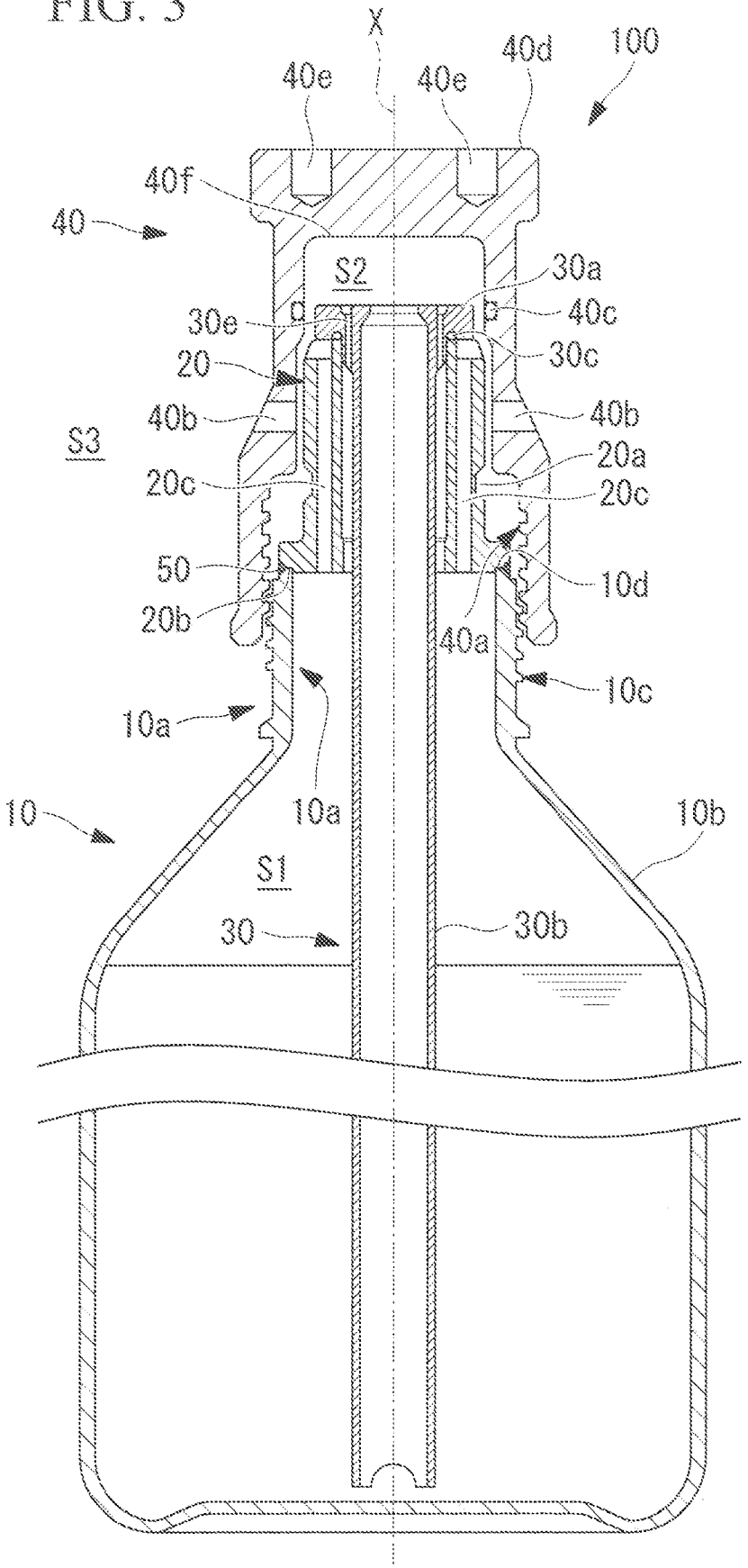
FIG. 3 is a vertical cross-sectional view of a plug-integrating container according to an embodiment illustrating a cap and a container body not completely fastened together.

As illustrated in FIG. 3, the dip tube 30 has gas flow channels 30*e* each at the same distance from the axis X for communicating the inner space S1 of the container body 10 with the outer space S2 of the plug 20. As illustrated in FIG. 3, the gas flow channels 30*e* each communicate the inner space S1 of the container body 10 with the outer space S2 of the plug 20 when the top surface of the flange part 30*a* of the dip tube 30 and the bottom surface 40*f* of the cap 40 are spaced from each other.

The cap 40 is cylindrically formed with a closed top surface 40*d*. The cap 40 is formed of a high density polyethylene (HDPE) or a fluorocarbon resin (e.g., PFA), for example. The cap 40 includes the internal threads 40*a* formed on its inner circumferential surface close to the lower end along the axis X, a plurality of through holes 40*b*, and an O ring 40*c* (seal member).

The internal threads 40*a* are fastened to the external threads 10*c* formed on the outer circumferential surface of the opening part 10*a* of the container body 10. As illustrated in FIG. 2, the opening part 10*a* of the container body 10 and the plug 20 joined to the opening part 10*a* are accommodated inside the cap 40 when the external threads 10*c* of the container body 10 and the internal threads 40*a* of the cap 40 are completely fastened together.

The open end 10*d* of the container body 10 and the annular part 20*b* of the plug 20, which are joined together by welding using the welding material 50 only for a certain width around the axis X, have low resistance to external impact. Particularly when an impact is given to the plug 20 in a direction orthogonal to the axis X, the impact might act on the joint between the open end 10*d* and the annular part 20*b*, thereby damaging the joint.

In the present embodiment, the opening part 10*a* and the joint are accommodated inside the cap 40 when the container body 10 and the cap 40 are completely fastened together. Accordingly, an external impact acting on the cap 40 of the plug-integrating container 100 would be transferred from the cap 40 directly to the container body 10. This prevents damage of the joint between the open end 10*d* and the annular part 20*b* accommodated inside the cap 40.

Figure 4:
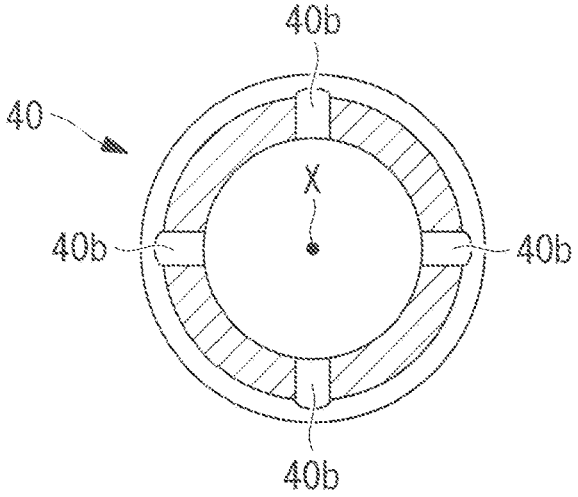
FIG. 4 is a cross-sectional view of the cap taken along the arrow A-A of FIG. 2.

The through holes 40*b* communicate the inside and the outside of the cap 40. As illustrated in FIG. 4, the through holes 40*b* are provided at four points at 90-degrees intervals around the axis X and formed to extend in the radial direction orthogonal to the axis X. It is to be noted that although through holes are provided at the four points in the present embodiment, through holes may be provided at any points, for example, at two points at 180-degrees intervals, and six points at 60-degrees intervals.

The O ring 40*c* is an endless elastic member attached to a groove formed on the inner circumferential surface of the cap 40 close to its upper end along the axis X. The O ring 40*c* comes into contact with the outer circumferential surface of the plug 20 to form a seal area along the entire circumference of the axis X when the external threads 10*c* of the container body 10 and the internal threads 40*a* of the cap 40 are completely fastened together. On the other hand, as illustrated in FIG. 3, the O ring 40*c* does not come into contact with the outer circumferential surface of the plug 20 to form the seal area along the entire circumference of the axis X when the external threads 10*c* of the container body 10 and the internal threads 40*a* of the cap 40 are not completely fastened together.

In this way, in the plug-integrating container 100 of the present embodiment, the seal area formed by the O ring 40*c* switches from the formed state to the unformed state before the external threads 10*c* of the container body 10 and the internal threads 40*a* of the cap 40 become unfastened from each other.

As illustrated in FIG. 2, the through holes 40*b* formed in the cap 40 are positioned not to communicate the inner space S1 of the container part 10*b* with space S3 outside the container part 10*b* when the seal area is formed by the O ring 40*c*. Also, as illustrated in FIG. 3, the through holes 40*b* formed in the cap 40 are positioned to communicate the inner space S1 of the container part 10*b* with the space S3 outside the container part 10*b* when the seal area is not formed by the O ring 40*c*.

In this way, in the plug-integrating container 100 of the present embodiment, the inner space S1 of the container part 10*b* starts to communicate with the through holes 40*b* midway through release of the complete fastening between the cap 40 and the container body 10. Accordingly, even when the inner space S1 of the container part 10*b* is pressurized above atmospheric pressure due to a gas generated from the liquid, the gas flows out of the space S1 to the space S3 outside through the through holes 40*b*, causing the pressure in the inner space S1 of the container part 10*b* to correspond to the atmospheric pressure before the cap 40 is removed from the container body 10.

This suppresses the cap 40 from flying when being removed from the container body 10 and the stored liquid from flowing out of the container body 10.

Figure 5:
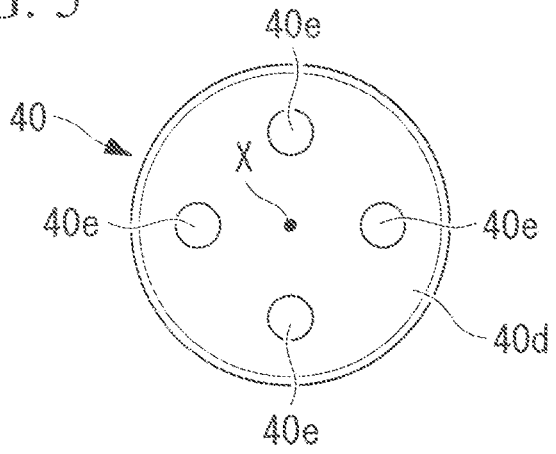
FIG. 5 is a plan view of the cap in FIG. 2 as seen in an axial direction.

As illustrated in FIG. 5, the cap 40 has on the top surface 40*d* jig receiving holes at four points each at the same distance from the axis X and spaced uniformly from each other around the axis X. The jig receiving holes 40*e* receive a jig for rotating the cap 40 around the axis X to fasten or remove the cap 40 to or from the container body 10.

Figure 7:
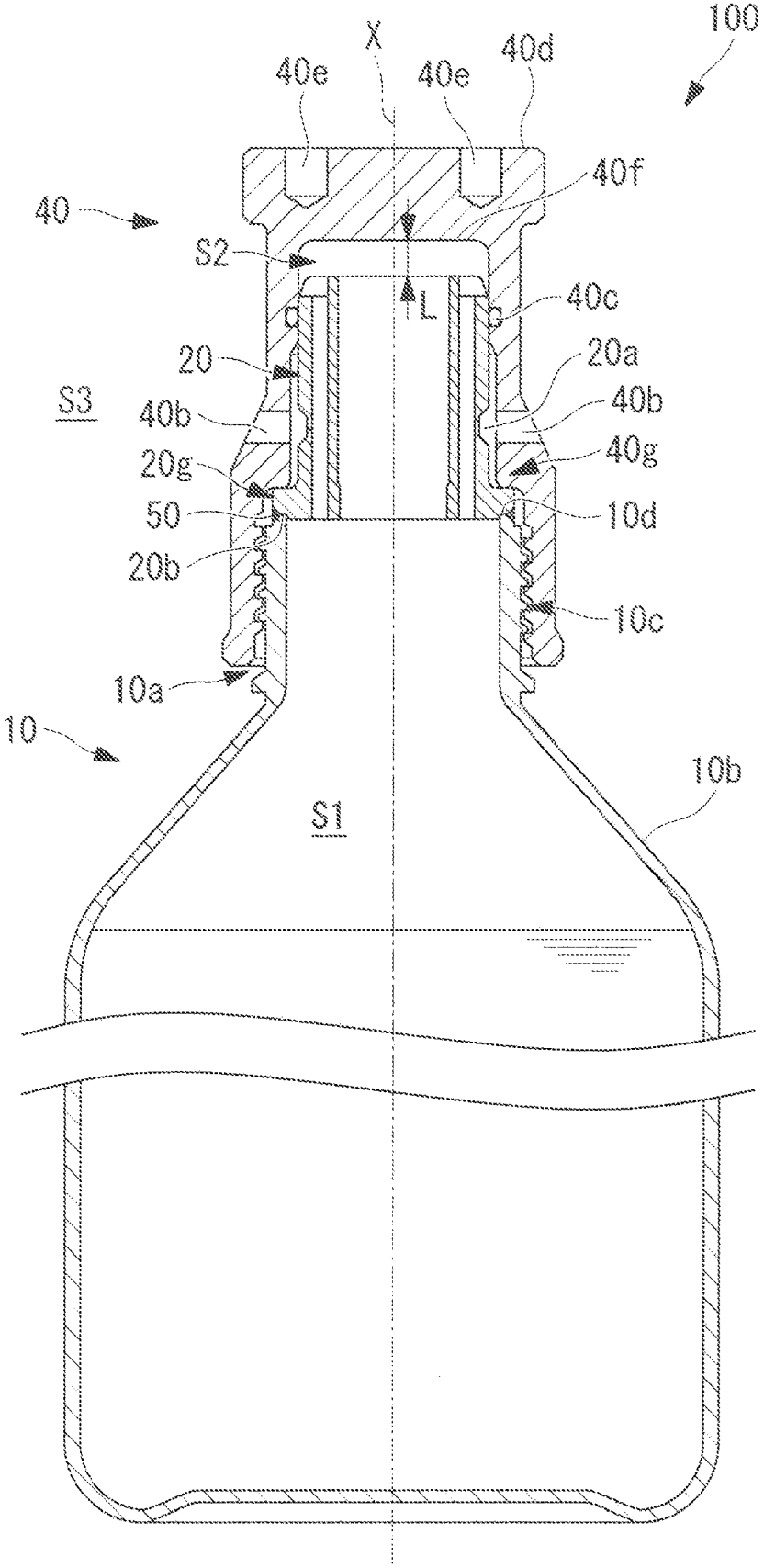
FIG. 7 is a vertical cross-sectional view of a plug-integrating container according to an embodiment illustrating a cap and a container body completely fastened together.

In the foregoing description, the plug-integrating container 100 has been described to have a configuration with the dip tube 30 as illustrated in FIG. 2, although the plug-integrating container 100 may have a configuration without the dip tube 30 as illustrated in FIG. 7. In the case of the configuration in FIG. 7, the plug-integrating container 100 is transported or stored without the dip tube 30. Then, in extracting the liquid stored inside the container body 10, the cap 40 is unfastened from the container body 10 to be removed, the dip tube 30 is inserted through the plug 20 into the container body 10, and the socket 200 that will be discussed later is attached to the plug 20.

In the plug-integrating container 100 illustrated in FIG. 7, an outer space S2 is formed, when the external threads 10*c* of the container body 10 and the internal threads 40*a* of the cap 40 are completely fastened together, between the top surface of the plug 20 and the bottom surface 40*f* of the cap 40 facing the top surface which are spaced by a distance L (predetermined distance). The distance L generally corresponds to a length of the flange part 30*a* along the axis X of the dip tube 30 illustrated in FIGS. 1 to 3. Here, as illustrated in FIG. 7, the external threads 10*c* of the container body 10 and the internal threads 40*a* of the cap 40 are completely fastened together by a step part 40*g* of the cap 40 contacting a shoulder part 20*g* of the plug 20.

According to the plug-integrating container 100 illustrated in FIG. 7, which is transported or stored without the dip tube 30, it is avoided that the plug-integrating container 100 is transported or stored with the dip tube 30 in contact with the liquid. This reliably prevents mixing of foreign matter or the like into the liquid due to the dip tube 30 contacting the liquid.

In addition, the outer space S2 which can accommodate the flange part 30*a* of the dip tube 30 is secured inside the plug-integrating container 100. Accordingly, the plug-integrating container 100 of the present embodiment can be transported or stored with or without the dip tube 30 accommodated inside.

Next, with reference to FIGS. 8 and 9, the socket 200 attached to the plug-integrating container 100 and extraction of the liquid by the socket 200 will be described.

The socket 200 is a device attached to the plug 20 of the plug-integrating container 100 for extracting the liquid stored in the container body 10 through the dip tube 30.

The socket 200 includes a socket body 61, an outer sleeve 62, an inner sleeve 63, a discharge port member 64, a valve mechanism 65, a lock mechanism 66, and a lock member 67.

The socket body 61 is an approximately cylindrical member extending along the axis X and has the outer sleeve 62 attached to an outer circumferential surface thereof close to its lower end along the axis X, the inner sleeve 63 attached to an inner circumferential surface of a middle part thereof along the axis X, and the discharge port member 64 attached to the inner circumferential surface close to its upper end along the axis X.

The socket body 61 has an O ring 61*a* attached to the inner circumferential surface thereof close to the lower end. As illustrated in FIG. 9, the O ring 61*a* forms an endless seal area extending around the axis X between the socket body 61 and the outer circumferential surface of the plug 20 when the socket 200 is attached to the plug 20.

The outer sleeve 62 is an approximately cylindrical member held at the outer circumferential surface of the lower end of the socket body 61. The outer sleeve 62 has a projection part 62*a* projecting inwardly on an inner circumferential surface thereof close to its lower end. The projection part 62*a* engages the outer circumferential surface of the socket body 61 close to the lower end, so that the outer sleeve 62 is held by the socket body 61.

The inner sleeve 63 is a cylindrical member with a liquid flow channel 63*a* formed inside. The inner sleeve 63 has on its outer circumferential surface slits 63*b* extending along the axis X at a plurality of points around the axis X. Pressure regulating gas supplied from an external pressure source (not illustrated) is guided via a gas connection port 70 to a gas supply port P1. The slits 63*b* form flow channels through which the pressure regulating gas guided to the gas supply port P1 is guided downward along the direction of the axis X.

A space below each slit 63*b* communicates with the inner space S1 of the plug-integrating container 100 when the socket 200 is attached to the plug 20. Accordingly, the pressure regulating gas is supplied through the gas supply port P1 to the inner space S1 of the plug-integrating container 100 with the socket 200 attached to the plug 20.

The discharge port member 64 is attached to the upper end part of the socket body 61 and has inside a flow channel through which a liquid flows and a discharge port P2. The discharge port P2 is connected to an external suction source (not illustrated), and the liquid inside the plug-integrating container 100 can be extracted by reducing the pressure at the discharge port P2 sufficiently below the pressure in the inner space S1 of the plug-integrating container 100.

The valve mechanism 65 has a flow channel through which a liquid flows along the axis X and switches the flow channel between a flowing state and a sealed state.

The valve mechanism 65 includes a valve plug 65*a*, a compression coil spring 65*d*, a coupling seat 65*c*, and a bellows 65*d*. As illustrated in FIG. 8, the coupling seat 65*c* is biased downwardly along the axis X by a biasing force of the compression coil spring 65*d* when the socket 200 is not attached to the plug 20 of the plug-integrating container 100. Thus, the coupling seat 65*c* contacts the valve plug 65*a* to bring the flow channel into the sealed state, in which spaces above and below the valve plug 65*a* along the axis X do not communicate with each other.

Figure 9:
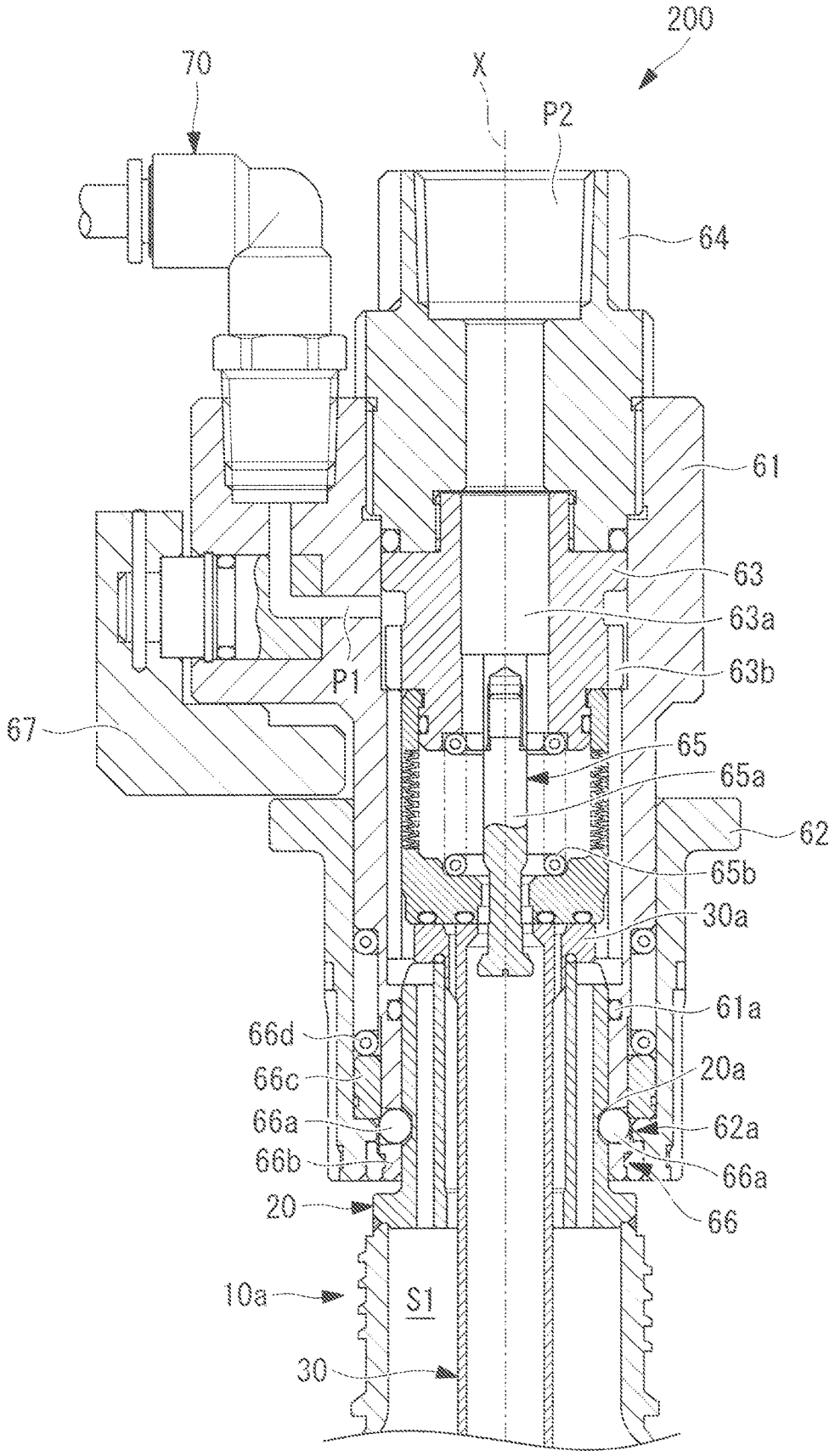
FIG. 9 is a vertical cross-sectional view of a socket coupled to the plug-integrating container.

On the other hand, as illustrated in FIG. 9, the coupling seat 65*c* contacts a top surface of the dip tube 30 to be pressed back upwardly along the axis X when the socket 200 is attached to the plug 20 of the plug-integrating container 100. Thus, the coupling seat 65*c* does not contact the valve plug 65*a* to bring the flow channel into the flowing state, in which the spaces above and below the valve plug 65*a* along the axis X communicate with each other.

The lock mechanism 66 is a mechanism for attaching and fixing the socket 200 to the plug 20 of the plug-integrating container 100. The lock mechanism 66 includes a plurality of balls 66*a*, a ball retainer 66*b* for retaining the balls 66*a*, a slide ring 66*c*, and a compression coil spring 66*d*.

Figure 8:
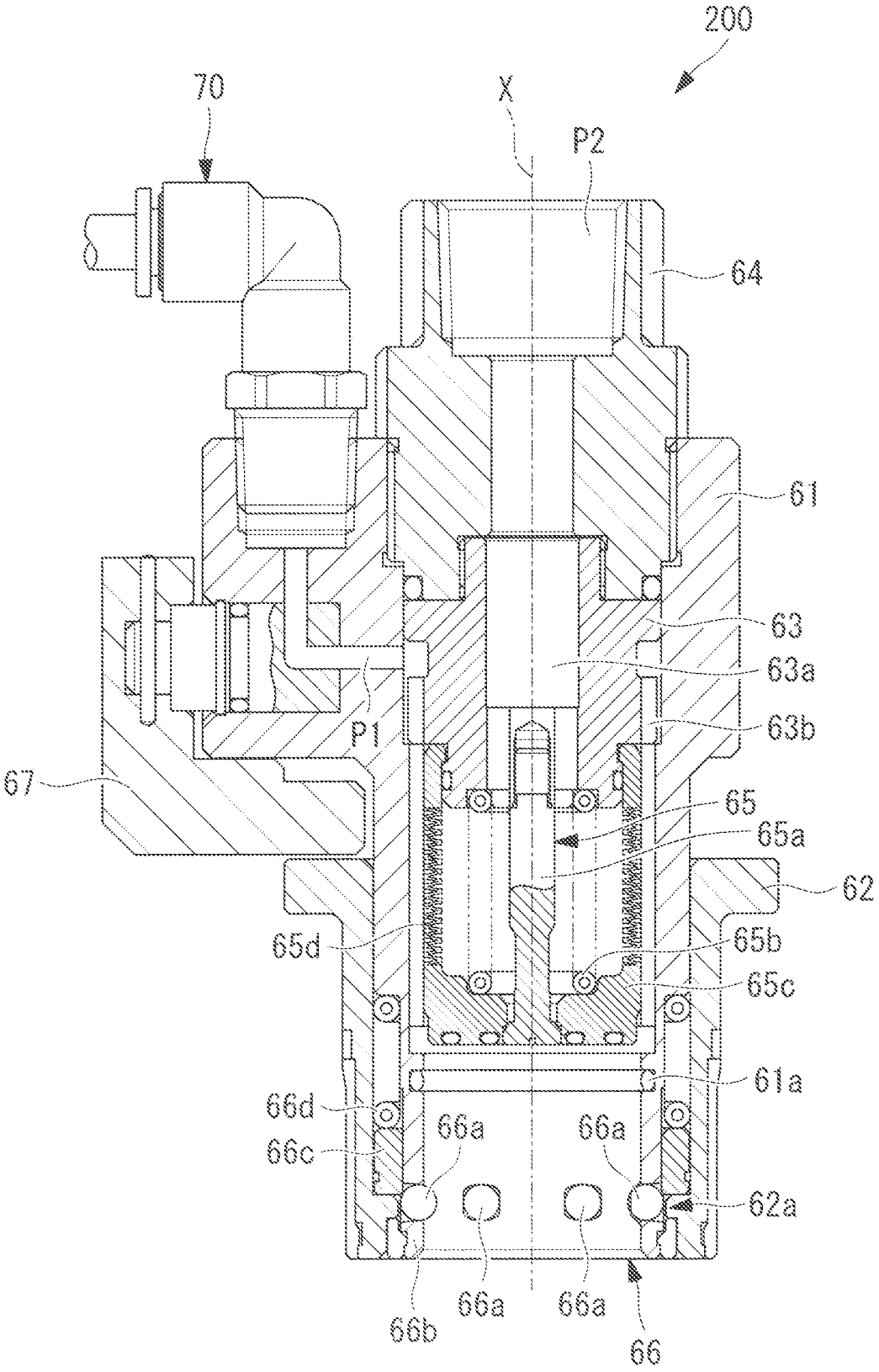
FIG. 8 is a vertical cross-sectional view of a socket according to an embodiment.

As illustrated in FIG. 8, a biasing force of the compression coil spring 66*d* biases the annular slide ring 66*c* downwardly along the axis X when the socket 200 is not attached to the plug 20 of the plug-integrating container 100 to bring the lock mechanism 66 into a locked state, in which the slide ring 66*c* contacts the projection part 62*a* of the outer sleeve 62. In the locked state, each of the balls 66*a* contacts the projection part 62*a* and is retained as partly projected inwardly beyond the inner circumferential surface of the socket body 61. Thus in the locked state, the balls 66*a* contact the outer circumferential surface of the plug 20, thereby preventing the socket 200 from being attached to the plug 20.

When the lock member 67 is retracted from the position illustrated in FIG. 8, the outer sleeve 62 is movable upwardly along the axis X. When an operator provides a force overcoming the biasing force of the compression coil spring 66*d* to lift the outer sleeve 62 upwardly along the axis X, the projection part 62*a* and the slide ring 66*c* move upwardly to bring the lock mechanism 66 into an unlocked state, in which the projection part 62*a* does not contact the balls 66*a*.

In the unlocked state, the balls 66*a* do not project inwardly beyond the inner circumferential surface of the socket body 61. Thus in the unlocked state, the balls 66*a* do not contact the outer circumferential surface of the plug 20, allowing the socket 200 to be attached to the plug 20.

When the plug 20 is inserted into the socket 200 in the unlocked state, and the operator releases the outer sleeve 62 which is lifted upwardly along the axis X, the lock mechanism 66 is brought into the locked state illustrated in FIG. 9. Such a locked state is achieved by the biasing force of the compression coil spring 66*d* moving the projection part 62*a* and the slide ring 66*c* downwardly to bring the projection part 62*a* into contact with the balls 66*a*.

As illustrated in FIG. 9, when the lock mechanism 66 is brought into the locked state after the plug 20 is inserted into the socket 200, parts of the balls 66*a* projecting inwardly beyond the inner circumferential surface of the socket body 61 are locked as engaged with the locking groove 20*a* of the plug 20. Consequently, the plug 20 and the socket 200 are not movable relative to each other along the direction of the axis X. Thus, the socket 200 is attached to the plug-integrating container 100.

In FIG. 9, the lock member 67 which has been retracted to achieve the unlocked state is returned to the original position illustrated in FIG. 8. When the lock member 67 is in the position illustrated in FIG. 9, the locked state by the lock mechanism 66 will not be released even if the operator tries to lift the outer sleeve 62 upwardly by mistake. In this way, the lock member 67 functions as a safety mechanism for maintaining the locked state of the lock mechanism 66.

In the state illustrated in FIG. 9, the gas supply port P1 communicates with the inner space S1 of the plug-integrating container 100. Also, the discharge port P2 communicates with the inside of the dip tube 30. Accordingly, the liquid inside the plug-integrating container 100 can be extracted by reducing the pressure at the discharge port P2 sufficiently below the pressure in the inner space S1 of the plug-integrating container 100 by the external suction source (not illustrated). The pressure regulating gas is supplied via the gas supply port P1 into the inner space S1 for regulating the pressure in the inner space S1 reduced by the extraction of the liquid.

The operations and effects of the plug-integrating container 100 of the present embodiment as described above will be described.

According to the plug-integrating container 100 of the present embodiment, the open end 10*d* formed at the axis X directional end of the opening part 10*a* of the container body 10 extending along the axis X and the annular part 20*b* formed at the axis X directional end of the cylindrically formed plug 20 extending along the axis X are joined together by heat bonding or welding as they are butted against each other. Because the plug 20 has the locking groove 20*a* for connection to the socket 200, the socket 200 for filling in or extracting a liquid can be easily connected to the plug 20 joined to the container body 10 containing the liquid.

The joint obtained by heat bonding or welding might be damaged by an external impact exerting a force acting on the plug 20 in a direction orthogonal to the direction of the axis X. According to the plug-integrating container 100 of the present embodiment, the opening part 10*a* of the container body 10 and the plug 20 joined to the opening part 10*a* are accommodated inside the cap 40 when the external threads 10*c* formed on the outer circumferential surface of the opening part 10*a* of the container body 10 and the internal threads 40*a* formed on the inner circumferential surface of the cap 40 are fastened together. This prevents damage of the joint between the container body 10 and the plug 20 due to an external impact exerting a force acting on the plug 20 in a direction orthogonal to the direction of the axis X.

According to the plug-integrating container 100 of the present embodiment, the O ring 40*c* forms the seal area between the inner circumferential surface of the cap 40 and the outer circumferential surface of the plug 20 when the external threads 10*c* formed on the outer circumferential surface of the opening part 10*a* of the container body 10 and the internal threads 40*a* formed on the inner circumferential surface of the cap 40 are completely fastened together. This prevents in the completely fastened state the gas generated from the liquid such as a chemical contained inside the container body 10 from leaking out of the container body 10.

In addition, according to the plug-integrating container 100 of the present embodiment, the seal area switches from the formed state to the unformed state before the external threads 10*c* and the internal threads 40*a* become unfastened from each other. Accordingly, the seal area switches into the unformed state to allow the gas generated inside the container body 10 to flow out through the through holes 40*b* before the external threads 10*c* and the internal threads 40*a* become unfastened from each other. As a result, the pressure inside the container body 10 generally corresponds to the outside pressure at the time the external threads 10*c* and the internal threads 40*a* become unfastened from each other. The gas flows out through the through holes 40*b* before the external threads 10*c* and the internal threads 40*a* become unfastened from each other, and thus this prevents the gas generated inside the container body 10 from suddenly flowing out to fly the cap 40 or prevents the liquid contained in the container body 10 from leaking out.

In the plug-integrating container 100 of the present embodiment, the outer space S2 is formed, when the external threads 10*c* and the internal threads 40*a* are completely fastened together, between the top surface of the plug 20 and the bottom surface 40*f* of the cap 40 facing the top surface which are spaced by the distance L.

In this way, the outer space S2 can be secured for accommodating the dip tube 30 to be inserted into the container body 10 inside the cap 40. Accordingly, the plug-integrating container 100 can be transported or stored with or without the dip tube 30 accommodated in the container body 10.

The plug-integrating container 100 of the present embodiment includes the cylindrically formed dip tube 30 which extends along the axis X and is inserted through the plug 20 into the container body 10. The dip tube 30 includes the flange part 30*a* having the outer diameter D2 longer than the inner diameter D1 of the plug 20 and the tube body 30*b* having the outer diameter D3 shorter than the inner diameter D1 of the plug 20. The flange part 30*a* is placed such that when the external threads 10*c* and the internal threads 40*a* are completely fastened together, the flange part 30*a* is sandwiched between the top surface of the plug 20 and the bottom surface 40*f* of the cap 40 facing the top surface.

In this way, the container can be transported or stored with the flange part 30*a* of the dip tube 30 which is inserted into the container body 10 fixed as it is sandwiched between the top surface of the plug 20 and the bottom surface 40*f* of the cap 40 facing the top surface.

OTHER EMBODIMENTS

The present invention is not limited to the above embodiment, and modifications may be made as appropriate without departing from the scope of the present invention.

The invention claimed is:

1. A plug-integrating container, comprising:

a container body including a cylindrically formed opening part extending in an axial direction, the opening part having external threads formed on an outer circumferential surface thereof;

a cylindrically formed plug extending in the axial direction and having around the axis a groove part for connection to a socket; and a cap having formed on an inner circumferential surface thereof internal threads fastened to the external threads formed on the opening part, wherein the container body includes a first annular part formed at an end of the opening part in the axial direction, the plug includes a second annular part formed at an end in the axial direction and having the same diameter as that of the first annular part, the first annular part and the second annular part are joined together by heat bonding or are continuously integrated together by welding with heat as the first annular part and the second annular part are butted against each other, and the opening part and the plug joined to the opening part are accommodated inside the cap when the external threads and the internal threads are fastened together, wherein an outer space of the plug is formed between a top surface of the plug and a bottom surface of the cap facing the top surface, the top surface and the bottom surface being spaced by a predetermined distance when the external threads and the internal threads are completely fastened together, wherein a gas flow channel is provided in the plug, and the gas flow channel communicates an inner space of the container body with the outer space of the plug when the external threads and the internal threads are completely fastened together, wherein a seal member is attached to an inner circumferential surface of the cap, the seal member contacting an outer circumferential surface of the plug to form a seal area along the entire circumference of the axis, the cap includes a through hole disposed only at a position such that the through hole does not communicate with the inner space of the container body when the seal area is in a formed state, and the seal area switches from the formed state to an unformed state to communicate the inner space of the container body with the position where the through hole is disposed through the outer space of the plug and the gas flow channel before the external threads and the internal threads become unfastened from each other.

2. The plug-integrating container according to claim 1 further comprising a cylindrically formed tube extending in the axial direction and inserted through the plug into the container body, wherein, the tube includes a flange part having a diameter longer than an inner diameter of the plug and a tube body having a diameter shorter than the inner diameter of the plug, and the flange part is disposed such that when the external threads and the internal threads are completely fastened together, the flange part is sandwiched between the top surface of the plug and the bottom surface of the cap facing the top surface.

* * * * *